US012012959B2

(12) United States Patent
Teshima et al.

(10) Patent No.: US 12,012,959 B2
(45) Date of Patent: Jun. 18, 2024

(54) SCROLL COMPRESSOR

(71) Applicant: SANDEN CORPORATION, Isesaki (JP)

(72) Inventors: Atsuo Teshima, Isesaki (JP); Misako Kaburagi, Isesaki (JP); Tetsuya Imai, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 0 days.

(21) Appl. No.: 18/256,572

(22) PCT Filed: Nov. 19, 2021

(86) PCT No.: PCT/JP2021/042521

§ 371 (c)(1),
(2) Date: Jun. 8, 2023

(87) PCT Pub. No.: WO2022/137923

PCT Pub. Date: Jun. 30, 2022

(65) Prior Publication Data

US 2024/0026881 A1 Jan. 25, 2024

(30) Foreign Application Priority Data

Dec. 22, 2020 (JP) ..... 2020-211995

(51) Int. Cl.
*F04C 18/02* (2006.01)
*F04C 23/00* (2006.01)
*F04C 29/00* (2006.01)

(52) U.S. Cl.
CPC ..... *F04C 18/0215* (2013.01); *F04C 23/008* (2013.01); *F04C 29/0021* (2013.01);
(Continued)

(58) Field of Classification Search
CPC ..... F04C 2/025; F04C 18/0207–0292; F04C 2240/56; F04C 2240/807; F01C 1/0207–0292
See application file for complete search history.

(56) References Cited

U.S. PATENT DOCUMENTS

2019/0301464 A1 10/2019 Kuma et al.
2023/0323880 A1* 10/2023 Busch ..... F04C 18/0215 418/55.1

FOREIGN PATENT DOCUMENTS

JP 11-148468 A 6/1999
JP 2019-100246 A 6/2019
(Continued)

OTHER PUBLICATIONS

Japan Patent Office, International Search Report issued in International Patent Application No. PCT/JP2021/042521, mailed Jan. 18, 2022.

*Primary Examiner* — Laert Dounis
(74) *Attorney, Agent, or Firm* — Baker Botts L.L.P.

(57) ABSTRACT

[Problem] To reduce imbalance among all movable components of a scroll compressor including a drive shaft and components fixed or connected to the drive shaft. In a scroll compressor 10, a shaft balancer 31 integrated with a drive shaft 30 includes a first weight 33 disposed on the opposite side from an eccentric pin 71 with respect to a center line CL0 of the drive shaft 30, and a bushing balancer 721 integrated with an eccentric bush 72 includes a second weight 723 disposed on the radially outer side of the eccentric bush 72 and on the opposite side from a center line CL1 of the eccentric pin 71 with respect to a center line CL2 of the eccentric bush 72. In a view from the axial direction of the drive shaft 30, the second weight 723 is symmetric with respect to a virtual line passing through the center of the drive shaft 30 and the center of the eccentric bush 72, and the first weight 33 is asymmetric with respect to the virtual line.

9 Claims, 4 Drawing Sheets

(52) U.S. Cl.
CPC ..... *F04C 29/005* (2013.01); *F04C 29/0057* (2013.01); *F04C 2240/56* (2013.01); *F04C 2240/807* (2013.01)

(56) References Cited

FOREIGN PATENT DOCUMENTS

| | | | | |
|---|---|---|---|---|
| JP | 2019-183832 | A | | 10/2019 |
| WO | WO-2023203939 | A1 | * | 10/2023 |

* cited by examiner

SCROLL COMPRESSOR

CROSS-REFERENCE TO RELATED APPLICATIONS

This application is a U.S. National Stage Patent Application under 37 U.S.C. § 371 of International Patent Application No. PCT/JP2021/042521, filed on Nov. 19, 2021, which claims the benefit of Japanese Patent Application No. JP 2020-211995, filed on Dec. 22, 2020, the disclosures of each of which are incorporated herein by reference in their entirety.

TECHNICAL FIELD

The present invention relates to a scroll compressor.

BACKGROUND ART

A scroll compressor includes a fixed scroll and an orbiting scroll that are arranged such that spiral walls of the fixed and orbiting scrolls mesh with each other. In the scroll compressor, the volume of a compression chamber formed between the spiral walls changes when the orbiting scroll orbits or revolves relative to the fixed scroll, and as a result, a fluid taken into the compression chamber is compressed. Also, a scroll compressor normally includes a balancer (which is also referred to as a balance weight or a counterweight) for reducing, for example, vibration resulting from the orbiting or revolving motion of the orbiting scroll.

For example, in the scroll compressor described in Patent Document 1, a driving force transmission mechanism for transmitting a driving force to the orbiting scroll includes a drive shaft to be rotated, a crank pin provided at an end of the drive shaft, and an eccentric bush that is fitted on the crank pin to be able to relatively rotate and is also fitted, via a bearing, into a cylindrical part on the back surface of the orbiting scroll to be able to relatively rotate; and a balancer (counterweight) is integrated with the eccentric bush.

REFERENCE DOCUMENT LIST

Patent Document

Patent Document 1: JP 2019-100246 A

SUMMARY OF THE INVENTION

Problem to be Solved by the Invention

In recent years, as the rotational speed of scroll compressors increases, there has been a demand for further improvement in the quietness and low vibration characteristics of scroll compressors. To improve the quietness and low vibration characteristics of scroll compressors, it is necessary to further reduce imbalance among all movable components including the drive shaft and components fixed or connected to the drive shaft.

For the above reason, an object of the present invention is to provide a scroll compressor configured to reduce imbalance among all movable components including the drive shaft and components fixed or connected to the drive shaft.

Means for Solving the Problem

As a result of intensive studies and experiments, the inventors of the present invention have discovered that imbalance among all movable components including the drive shaft and components fixed or connected to the drive shaft can be further reduced by providing multiple balancers at appropriate positions. The present invention has been made based on this discovery.

According to an aspect of the present invention, a scroll compressor includes a fixed scroll including a fixed base plate and a fixed spiral wall erected on the fixed base plate; an orbiting scroll including an orbiting base plate, an orbiting spiral wall that is erected on one surface of the orbiting base plate and meshes with the fixed spiral wall, and a cylindrical part erected on another surface of the orbiting base plate; a compression chamber formed between the fixed scroll and the orbiting scroll; and a driving force transmission mechanism that includes a drive shaft to be rotated, an eccentric pin provided at one end of the drive shaft, and an eccentric bush rotatably attached to the eccentric pin and rotatably inserted into the cylindrical part via a bearing, and transmits a driving force to the orbiting scroll. The scroll compressor is configured such that the volume of the compression chamber changes and a fluid taken into the compression chamber is thereby compressed when the orbiting scroll orbits by the driving force relative to the fixed scroll. The scroll compressor further includes a shaft balancer that is integrated with the drive shaft and includes a first weight disposed on the opposite side from the eccentric pin with respect to the center line of the drive shaft, and a bushing balancer that is integrated with the eccentric bush and includes a second weight disposed on the radially outer side of the eccentric bush and on the opposite side from the center line of the eccentric pin with respect to the center line of the eccentric bush. In a view from the axial direction of the drive shaft, the second weight is symmetric with respect to a virtual line passing through the center of the drive shaft and the center of the eccentric bush, and the first weight is asymmetric with respect to the virtual line.

Effects of the Invention

An aspect of the present invention makes it possible to provide a scroll compressor configured to reduce imbalance among all movable components including a drive shaft and components fixed or connected to the drive shaft.

MODE FOR CARRYING OUT THE INVENTION

An embodiment of the present invention is described below with reference to the accompanying drawings.

Figure 1:
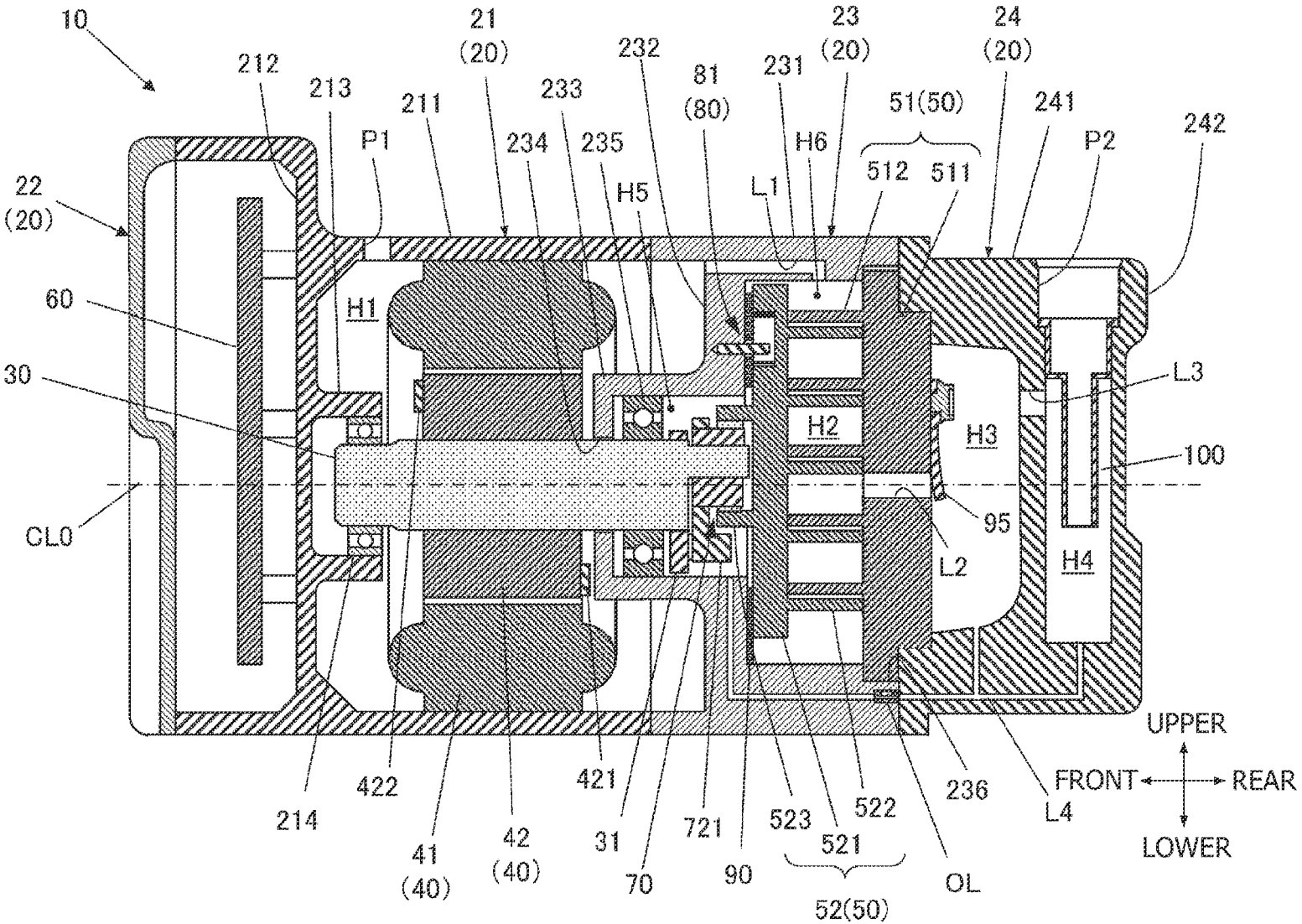
FIG. 1 is a cross-sectional view illustrating a schematic configuration of a scroll compressor according to an embodiment.

FIG. 1 is a cross-sectional view illustrating a schematic configuration of a scroll compressor according to an embodiment of the present invention. For example, a scroll compressor 10 according to an embodiment is incorporated into a refrigerant circuit of a vehicle air conditioner and configured to compress a low-pressure gaseous refrigerant (fluid) received from the refrigerant circuit, and to send the resulting high-pressure gaseous refrigerant back into the refrigerant circuit. In FIG. 1, the left side corresponds to the front side of the scroll compressor 10, the right side corresponds to the rear side of the scroll compressor 10, the upper side corresponds to the upper side of the scroll compressor 10, and the lower side corresponds to the lower side of the scroll compressor 10. Also, in FIG. 1, the near side corresponds to the left side of the scroll compressor 10, and the far side corresponds to the right side of the scroll compressor 10.

The scroll compressor 10 includes a housing 20, a drive shaft 30, an electric motor 40 that rotates the drive shaft 30, a scroll unit 50 that is driven via the drive shaft 30 and compresses a (low-pressure) gaseous refrigerant, and an inverter 60 that drives and controls the electric motor 40. The drive shaft 30, the electric motor 40, the scroll unit 50, and the inverter 60 are housed in the housing 20. The scroll unit 50 includes a fixed scroll 51 and an orbiting scroll 52 that orbits relative to the fixed scroll 51.

The housing 20 includes a front housing 21, a cover part 22, a center housing 23, and a rear housing 24. These components are fastened to each other with, for example, fastening parts (not shown) to form the housing 20 of the scroll compressor 10.

The front housing 21 includes a peripheral wall (hereafter referred to as "first peripheral wall") 211 that has a cylindrical shape and extends in the longitudinal direction, and a partition (hereafter referred to as "first partition") 212 that partitions the interior of the first peripheral wall 211 into front and rear spaces. The front end face of the first peripheral wall 211 forms the front end face of the front housing 21, and the rear end face of the first peripheral wall 211 forms the rear end face of the front housing 21. The interior of the first peripheral wall 211 (i.e., the internal space of the front housing 21) is partitioned by the first partition 212 into an inverter housing space that is on the front side and houses the inverter 60 and a motor housing space that is on the rear side and houses the electric motor 40. That is, the electric motor 40 and the inverter 60 are housed in the front housing 21.

The first partition 212 includes a support 213 that supports the front end of the drive shaft 30. The support 213 has a cylindrical shape protruding from the rear surface of the first partition 212 into the motor housing space and is configured to rotatably support the front end of the drive shaft 30 via a first bearing 214 fitted the cylindrical shape.

The cover part 22 is joined to the front end face of the front housing 21 to close the inverter housing space (or to form an inverter housing chamber). The front end face of the center housing 23 is joined to the rear end face of the front housing 21. A sealing part may be provided as necessary between the front housing 21 and the cover part 22 and between the front housing 21 and the center housing 23.

The center housing 23 includes a peripheral wall (hereafter referred to as "second peripheral wall") 231 with a cylindrical shape extending in the longitudinal direction, and a partition (hereafter referred to as "second partition") 232 that partitions the interior of the second peripheral wall 231 into front and rear spaces. The front end face of the second peripheral wall 231 forms the front end face of the center housing 23, and the rear end face of the second peripheral wall 231 forms the rear end face of the center housing 23. The interior of the second peripheral wall 231 (i.e., the internal space of the center housing 23) is partitioned by the second partition 232 into a connection space that is on the front side and connected to the motor housing space of the front housing 21 and a scroll housing space that is on the rear side and houses the scroll unit 50. That is, the scroll unit 50 is housed in the center housing 23.

The second partition 232 includes a hollow protrusion 233 that protrudes toward the front housing 21 (motor housing space). The hollow protrusion 233 is provided in the center of the second partition 232 in the radial direction to face the support 213 provided on the first partition 212 of the front housing 21. A shaft insertion hole 234 is formed in the distal end of the hollow protrusion 233 such that the inside and the outside of the hollow protrusion 233 communicate with each other. The drive shaft 30 is inserted into, and passes through, the shaft insertion hole 234. A second bearing 235 rotatably supporting the rear end portion of the drive shaft 30 is fitted in the hollow protrusion 233. In other words, in the present embodiment, the drive shaft 30 extends in the housing 20 in the longitudinal direction and is rotatably supported by the first bearing 214 provided in the front housing 21 and the second bearing 235 provided in the center housing 23.

The front end face of the rear housing 24 is joined to the rear end face of the center housing 23. In the present embodiment, a recess 236, in which the outer edge of a fixed base plate 511 (described later) of the fixed scroll 51 constituting the scroll unit 50 is placed, is formed in the rear end face of the center housing 23, i.e., the rear end face of the second peripheral wall 231. The outer edge of the fixed base plate 511 is placed in the recess 236 and is also sandwiched between the center housing 23 and the rear housing 24. With this configuration, the fixed scroll 51 is fixed, and the rear opening of the second peripheral wall 231 is closed by the fixed base plate 511 of the fixed scroll 51. A sealing part may be provided as necessary between the center housing 23 and the rear housing 24.

The rear housing 24 has a cylindrical shape with a bottom and includes a peripheral wall (hereafter referred to as "third peripheral wall") 241 having a cylindrical shape and extending in the longitudinal direction and a bottom wall 242 that closes the rear opening of the third peripheral wall 241. The front end face of the third peripheral wall 241 forming the front end face of the rear housing 24 is joined to the rear end face of the second peripheral wall 231 that is the rear end face of the center housing 23. Accordingly, the front opening of the third peripheral wall 241 is closed by the fixed base plate 511 of the fixed scroll 51.

The electric motor 40 is implemented by, for example, a three-phase alternating current motor and includes a stator core unit 41 and a rotor 42.

The stator core unit 41 is fixed to the inner peripheral surface of the first peripheral wall 211 of the front housing 21. A direct current from, for example, an automotive battery (not shown) is converted into an alternating current by the inverter 60, and the alternating current is supplied to the stator core unit 41.

The rotor 42 is disposed radially inside of the stator core unit 41 such that a predetermined gap is formed between the rotor 42 and the stator core unit 41. The rotor 42 includes a permanent magnet. The rotor 42 has a cylindrical shape and is fixed to the drive shaft 30 that is inserted into, and passes through, the internal space of the rotor 42. That is, the rotor 42 is integrated with the drive shaft 30 and rotates together with the drive shaft 30.

In the electric motor 40, when power is supplied from the inverter 60 and a magnetic field is generated in the stator core unit 41, the rotor 42 is rotated by a rotational force applied to the permanent magnet of the rotor 42, and as a result, the drive shaft 30 rotates (or is driven to rotate).

As described above, the scroll unit 50 includes the fixed scroll 51 and the orbiting scroll 52 that orbits relative to the fixed scroll 51.

The fixed scroll 51 includes a fixed base plate 511 with a disk shape and a fixed spiral wall 512 erected on one surface of the fixed base plate 511. The fixed spiral wall 512 extends spirally (along an involute curve) on the one surface of the fixed base plate 511 from a radially inner end (winding start position) to a radially outer end (winding end position). The fixed scroll 51 is fixed in such a state that one surface of the fixed base plate 511 (the surface on which the fixed spiral wall 512 is erected) faces forward and the outer edge of the fixed base plate 511 is placed in the recess 236 and sandwiched between the center housing 23 and the rear housing 24.

The orbiting scroll 52 includes an orbiting base plate 521 with a disk shape, an orbiting spiral wall 522 erected on one surface of the orbiting base plate 521, and a cylindrical part 523 that is formed on, and protrudes from, the other surface of the orbiting base plate 521. The orbiting spiral wall 522 extends spirally (along an involute curve) on the one surface of the orbiting base plate 521 from a radially inner end (winding start position) to a radially outer end (winding end position). The orbiting scroll 52 is disposed such that the orbiting spiral wall 522 meshes with the fixed spiral wall 512 of the fixed scroll 51. In other words, the orbiting scroll 52 is disposed between the second partition 232 of the center housing 23 and the fixed scroll 51 such that the one surface of the orbiting base plate 521 (the surface on which the orbiting spiral wall 522 is erected) faces backward. Here, the other surface of the orbiting base plate 521 may also be referred to as a back surface of the orbiting base plate 521.

The orbiting scroll 52 is driven by a driving force transmitted via the drive shaft 30 and a crank mechanism 70. The orbiting scroll 52 is configured to orbit relative to the fixed scroll 51, i.e., to revolve around the axial center of the fixed scroll 51 while the rotation of the orbiting scroll 52 is prevented by an anti-rotation mechanism 80. In the present embodiment, the drive shaft 30 and the crank mechanism 70 constitute a "driving force transmission mechanism" of the present invention.

The scroll unit 50 is configured such that a low-pressure gaseous refrigerant is taken into the scroll unit 50 and compressed when the orbiting scroll 52 orbits relative to the fixed scroll 51. A thrust plate 90 with an annular disk shape is disposed between the orbiting base plate 521 of the orbiting scroll 52 and the second partition 232 of the center housing 23, and the rear surface of the second partition 232 receives a thrust force from the orbiting scroll 52 via the thrust plate 90.

Figure 2:
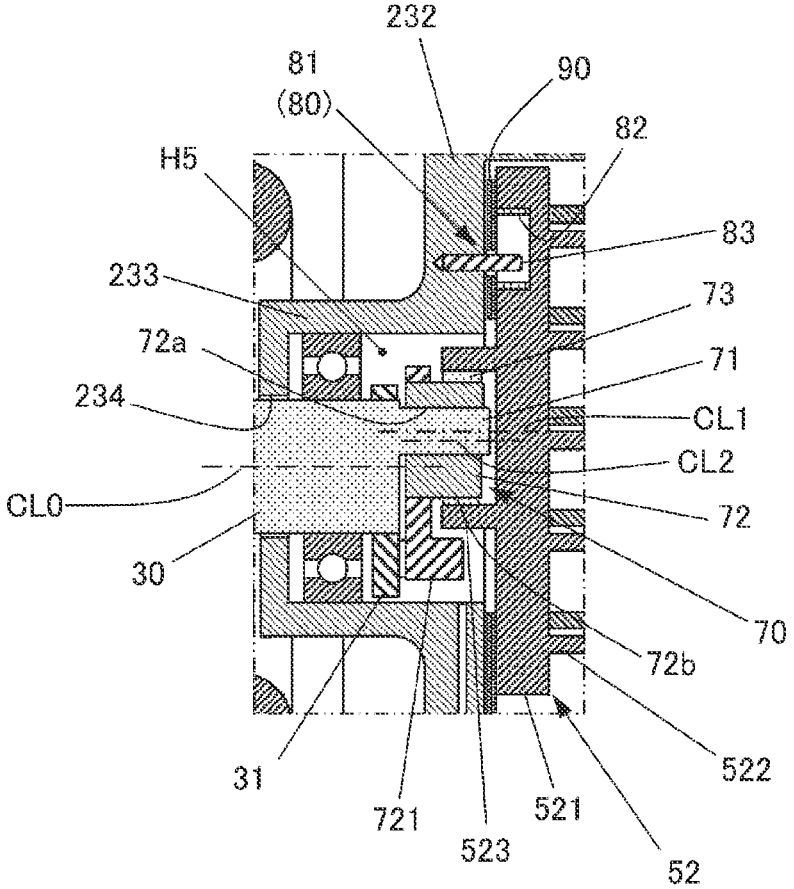
FIG. 2 is an enlarged view of a part of FIG. 1 including a crank mechanism and an anti-rotation mechanism.

FIG. 2 is an enlarged view of a part of FIG. 1 including the crank mechanism 70 and the anti-rotation mechanism 80.

The crank mechanism 70 is configured to couple the drive shaft 30 to the orbiting scroll 52 and convert the rotation of the drive shaft 30 to the orbiting motion of the orbiting scroll 52. As illustrated in FIG. 2, the crank mechanism 70 includes an eccentric pin 71 provided at the rear end of the drive shaft 30 and an eccentric bush 72 attached to the eccentric pin 71.

The eccentric pin 71 extends from the rear end face of the drive shaft 30 in the axial direction of the drive shaft 30. Also, the center of the eccentric pin 71 is shifted from the center of the drive shaft 30. That is, a center line CL1 of the eccentric pin 71 is shifted from a center line CL0 of the drive shaft 30.

The eccentric bush 72 is rotatably attached to the eccentric pin 71 and is rotatably inserted into the cylindrical part 523 of the orbiting scroll 52 via a bearing 73. Specifically, the eccentric bush 72 is formed in a columnar shape. Also, a pin insertion hole 72*a*, into which the eccentric pin 71 is rotatably inserted, is formed in the eccentric bush 72. The pin insertion hole 72*a* is formed in a position shifted from a center line CL2 of the eccentric bush 72 and passes through the eccentric bush 72 in the axial direction. The eccentric bush 72 is rotatably attached to the eccentric pin 71 by inserting the eccentric pin 71 into the pin insertion hole 72*a*. Accordingly, the center line of the pin insertion hole 72*a* corresponds to the center line CL1 of the eccentric pin 71. Also, the eccentric bush 72 is rotatably inserted into the cylindrical part 523 of the orbiting scroll 52 via the bearing 73 such that an outer peripheral surface 72*b* is supported by the bearing 73 attached to the inside of the cylindrical part 523 of the orbiting scroll 52.

The anti-rotation mechanism 80 is configured as a pin-ring anti-rotation mechanism and includes multiple rotation prevention parts 81. As illustrated in FIG. 2, each rotation prevention part 81 of the anti-rotation mechanism 80 includes a ring 82 press-fitted into a circular hole formed in the other surface (back surface) of the orbiting base plate 521 and a pin 83 that is fixed to the second partition 232 of the center housing 23, passes through the thrust plate 90, and extends to the inside of the ring 82. In the present embodiment, six circular holes are formed at regular intervals in the other surface (back surface) of the orbiting base plate 521 to surround the cylindrical part 523, and the ring 82 is press-fitted into each of the circular holes (see FIG. 3). Also, six pins 83 corresponding to the six rings 82 are fixed to the second partition 232 of the center housing 23. That is, in the present embodiment, the anti-rotation mechanism 80 includes six rotation prevention parts 81 arranged at regular intervals in the circumferential direction. However, the present invention is not limited to this example. The number of rotation prevention parts 81 may be set to any value as long as three or more rotation prevention parts 81 are provided.

Referring back to FIG. 1, the scroll compressor 10 includes an intake chamber H1 into which a low-pressure gaseous refrigerant flows, a compression chamber H2 that compresses the low-pressure gaseous refrigerant, a discharge chamber H3 into which the gaseous refrigerant compressed by the compression chamber H2 is discharged, a gas-liquid separation chamber H4 that separates a lubricant oil from the gaseous refrigerant compressed by the compression chamber H2, and a back pressure chamber H5 that faces the other surface (back surface) of the orbiting base plate 521 of the orbiting scroll 52.

The intake chamber H1 is enclosed and formed by the first peripheral wall 211 of the front housing 21, the first partition 212 of the front housing 21, the second peripheral wall 231 of the center housing 23, and the second partition 232 of the center housing 23. That is, in the present embodiment, the intake chamber H1 is constituted by the motor housing space of the front housing 21 and the connection space of the center housing 23. An intake port P1 is formed in the first peripheral wall 211. The intake port P1 is connected to (the low pressure side of) the refrigerant circuit via, for example, a connecting pipe (not shown). Accordingly, a low-pressure refrigerant from the refrigerant circuit flows into the intake chamber H1 via the intake port P1. Also, a refrigerant path L1 is formed in the center housing 23 to guide the low-pressure gaseous refrigerant in the intake chamber H1 to a space H6 near the outer end of the scroll unit 50.

The compression chamber H2 is formed between the fixed scroll 51 and the orbiting scroll 52. Specifically, in the scroll unit 50, when the orbiting scroll 52 orbits relative to the fixed scroll 51, the orbiting spiral wall 522 contacts the fixed spiral wall 512, and a crescent-shaped closed space is formed on the radially outer side by the fixed base plate 511, the fixed spiral wall 512, the orbiting base plate 521, and the orbiting spiral wall 522. The formed crescent-shaped closed space moves radially inward, and the volume of crescent-shaped closed space gradually decreases. The crescent-shaped closed space formed between the fixed scroll 51 and the orbiting scroll 52 forms the compression chamber H2. The scroll unit 50 is configured such that the low-pressure gaseous refrigerant is drawn from the space H6 and compressed when the crescent-shaped closed space (i.e., the compression chamber H2) is formed.

The discharge chamber H3 is enclosed and formed by the third peripheral wall 241 of the rear housing 24, the bottom wall 242 of the rear housing 24, and the fixed base plate 511 of the fixed scroll 51. That is, the inside of the third peripheral wall 241 of the rear housing 24 forms the discharge chamber H3. A discharge hole L2 is formed in the center of the fixed base plate 511 of the fixed scroll 51 in the radial direction so that the compression chamber H2 moved to the innermost position communicates with the discharge chamber H3. With this configuration, the gaseous refrigerant compressed by the compression chamber H2 of the scroll unit 50 is discharged into the discharge chamber H3 via the discharge hole L2. A check valve (reed valve) 95 is provided for the discharge hole L2 to allow the flow of the gaseous refrigerant from the compression chamber H2 to the discharge chamber H3 and prevent the flow of the gaseous refrigerant from the discharge chamber H3 to the compression chamber H2.

The gas-liquid separation chamber H4 is provided in the rear housing 24. Specifically, in the present embodiment, the gas-liquid separation chamber H4 is formed as a cylindrical space that extends downward from the outer peripheral surface to the inside along the bottom wall 242 of the rear housing 24. The discharge chamber H3 communicates with the gas-liquid separation chamber H4 via a communicating hole L3. An oil separator 100, which separates a lubricant oil included in the gaseous refrigerant, is disposed in the gas-liquid separation chamber H4. Although a centrifugal oil separator is used in the present embodiment, any other type of oil separator may also be used. A discharge port P2 is provided above the oil separator 100 in the gas-liquid separation chamber H4. The discharge port P2 is connected to (the high pressure side of) the refrigerant circuit via, for example, a connecting pipe (not shown).

The back pressure chamber H5 is formed between the orbiting base plate 521 of the orbiting scroll 52 and the second partition 232 of the center housing 23. In the present embodiment, the back pressure chamber H5 includes the internal space of the hollow protrusion 233 of the second partition 232. A lubricant oil path L4 is formed in the center housing 23 and the rear housing 24 to connect the discharge chamber H3 to the back pressure chamber H5 and connect the gas-liquid separation chamber H4 to the back pressure chamber H5. An orifice (aperture) OL is provided at an intermediate point in the lubricant oil path L4. The back pressure chamber H5 communicates with the intake chamber H1 via a small gap between the inner peripheral surface of the shaft insertion hole 234 and the outer peripheral surface of the drive shaft 30. However, the present invention is not limited to this example. The back pressure chamber H5 may also be configured to communicate with the intake chamber H1 via a pressure release path in the middle of which an orifice or a back pressure control valve is provided.

Here, the operation of the scroll compressor 10 is briefly described.

When power is supplied from the inverter 60, the electric motor 40 rotates the drive shaft 30, the rotation of the drive shaft 30 is transmitted to the orbiting scroll 52 via the crank mechanism 70, and the orbiting scroll 52 orbits relative to the fixed scroll 51. As a result, a low-pressure gaseous refrigerant from the refrigerant circuit flows into the intake chamber H1 via the intake port P1, passes through the refrigerant path L1 and reaches the space H6, is taken into the compression chamber H2 formed between the fixed scroll 51 and the orbiting scroll 52, and is then compressed. The gaseous refrigerant compressed by the compression chamber H2 (high-pressure gaseous refrigerant) is discharged into the discharge chamber H3 via the discharge hole L2 (and the check valve 95) and then flows into the gas-liquid separation chamber H4 via the communicating hole L3. The lubricant oil included in the gaseous refrigerant that flowed into the gas-liquid separation chamber H4 is separated by the oil separator 100. After the lubricant oil is separated by the oil separator 100, the gaseous refrigerant is sent to the refrigerant circuit via the discharge port P2. On the other hand, the lubricant oil separated from the gaseous refrigerant by the oil separator 100 is accumulated at the bottom of the gas-liquid separation chamber H4. Also, a part of the lubricant oil included in the gaseous refrigerant discharged into the discharge chamber H3 is accumulated at the bottom of the discharge chamber H3.

The back pressure chamber H5 communicates with the discharge chamber H3 and the gas-liquid separation chamber H4 via the lubricant oil path L4, and also communicates with the intake chamber H1 via the small gap between the inner peripheral surface of the shaft insertion hole 234 and the outer peripheral surface of the drive shaft 30. With this configuration, the lubricant oil accumulated at the bottom of the discharge chamber H3 and/or the bottom of the gas-liquid separation chamber H4 is supplied to the back pressure chamber H5 via the lubricant oil path L4 after being depressurized by the orifice OL. Also, the back pressure chamber H5 communicates with the intake chamber H1 via the small gap, and the flow of the lubricant oil (and/or the gaseous refrigerant) from the back pressure chamber H5 to the intake chamber H1 is limited. Therefore, the pressure in the back pressure chamber H5 is maintained at an intermediate pressure Pm between a pressure Ps in the intake chamber H1 and a pressure Pd in the discharge chamber H3 (=pressure in the gas-liquid separation chamber H4). The orbiting scroll 52 is pressed by the intermediate pressure Pm toward the fixed scroll 51. That is, the back pressure chamber H5 applies the pressure (back pressure) Pm to the orbiting scroll 52 to press the orbiting scroll 52 toward the fixed scroll 51.

Next, a configuration of the scroll compressor 10 for achieving a balance among all movable components including the drive shaft 30 and components fixed to, or connected to, the drive shaft 30 and for maintaining the proper pressing force of the orbiting spiral wall 522 against the fixed spiral wall 512 is described.

The scroll compressor 10 has such a configuration primarily to suppress the generation of noise caused by the vibration of the first bearing 214 and the second bearing 235 supporting the drive shaft 30 and to prevent the increase in the wear of the fixed spiral wall 512 and/or the orbiting spiral wall 522 and the damage on the fixed spiral wall 512 and/or the orbiting spiral wall 522 due to an increase in the pressing force of the orbiting spiral wall 522 against the fixed spiral wall 512. In the present embodiment, the movable components mainly correspond to the drive shaft 30, the rotor 42 fixed to the drive shaft 30, the eccentric bush 72 attached to the eccentric pin 71 of the drive shaft 30, and the orbiting scroll 52 including the cylindrical part 523 to which the bearing 73 is attached.

Referring to FIGS. 1 and 2, as a configuration for achieving balance among all movable components and maintaining the proper pressing force of the orbiting spiral wall 522 against the fixed spiral wall 512, the scroll compressor 10 includes a balancer (hereafter referred to as "shaft balancer") 31 integrated with the drive shaft 30, a balancer (hereafter referred to as "bushing balancer") 721 integrated with the eccentric bush 72, and two balancers (hereafter referred to as "first rotor balancer 421" and "second rotor balancer 422") integrated with the rotor 42.

Figure 3:
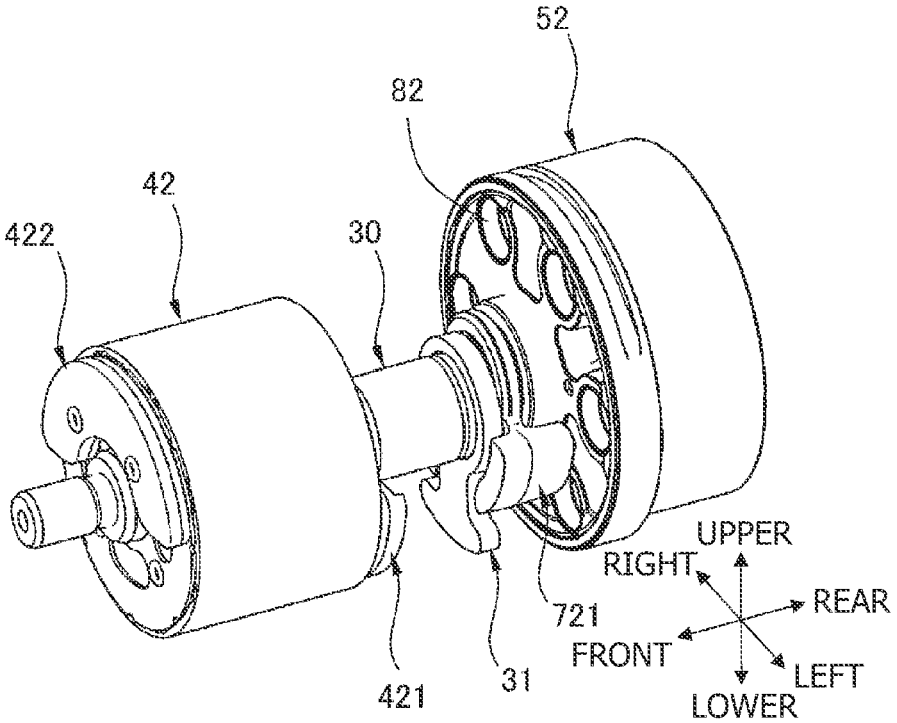
FIG. 3 is a perspective view illustrating an arrangement of a shaft balancer, a bushing balancer, a first rotor balancer, and a second rotor balancer.
Figure 4:
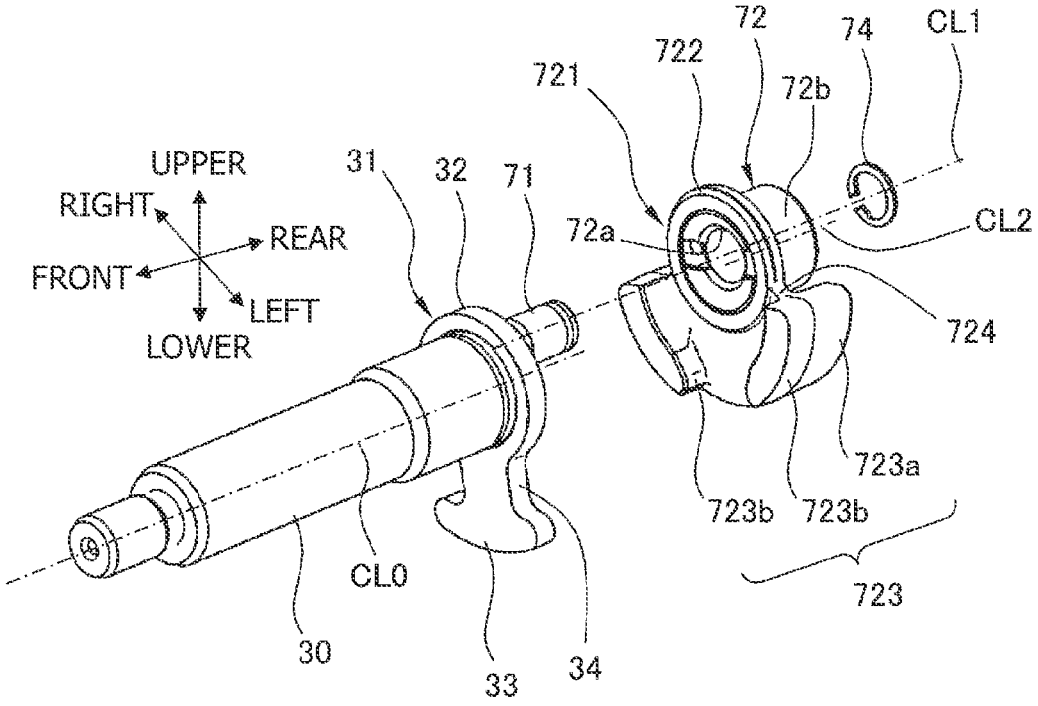
FIG. 4 is an exploded perspective view mainly illustrating a shaft balancer and a bushing balancer.
Figure 5:
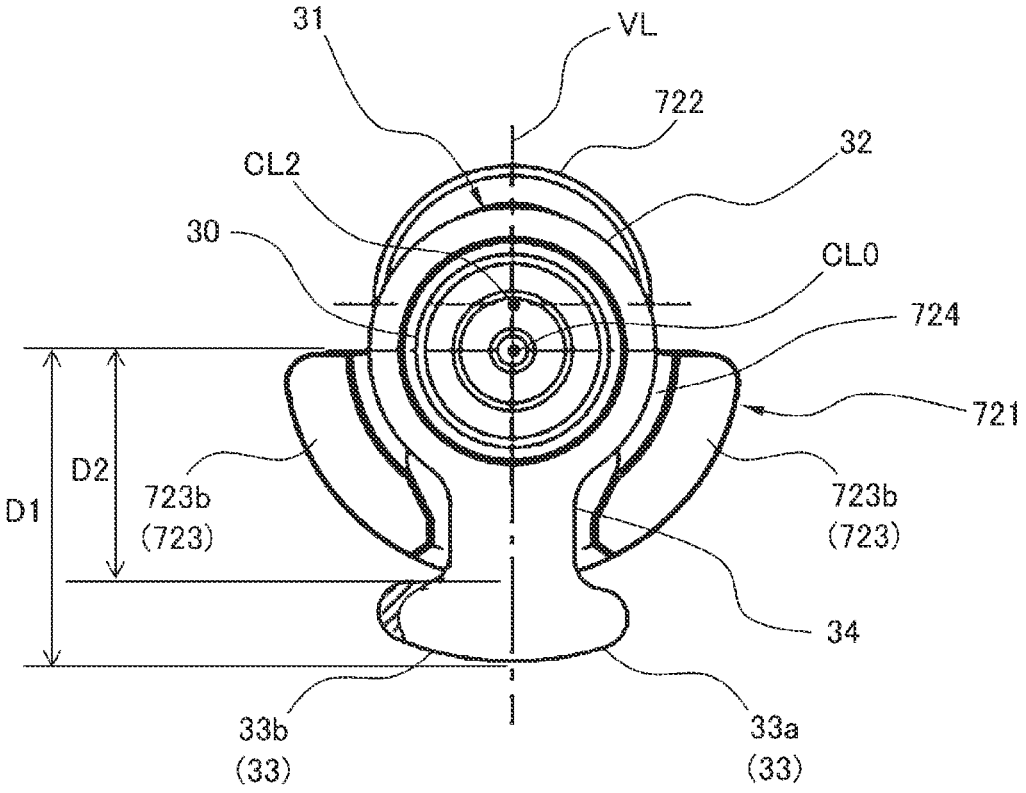
FIG. 5 is a drawing illustrating a shaft balancer and a bushing balancer seen from the axial direction of a drive shaft.
Figure 6:
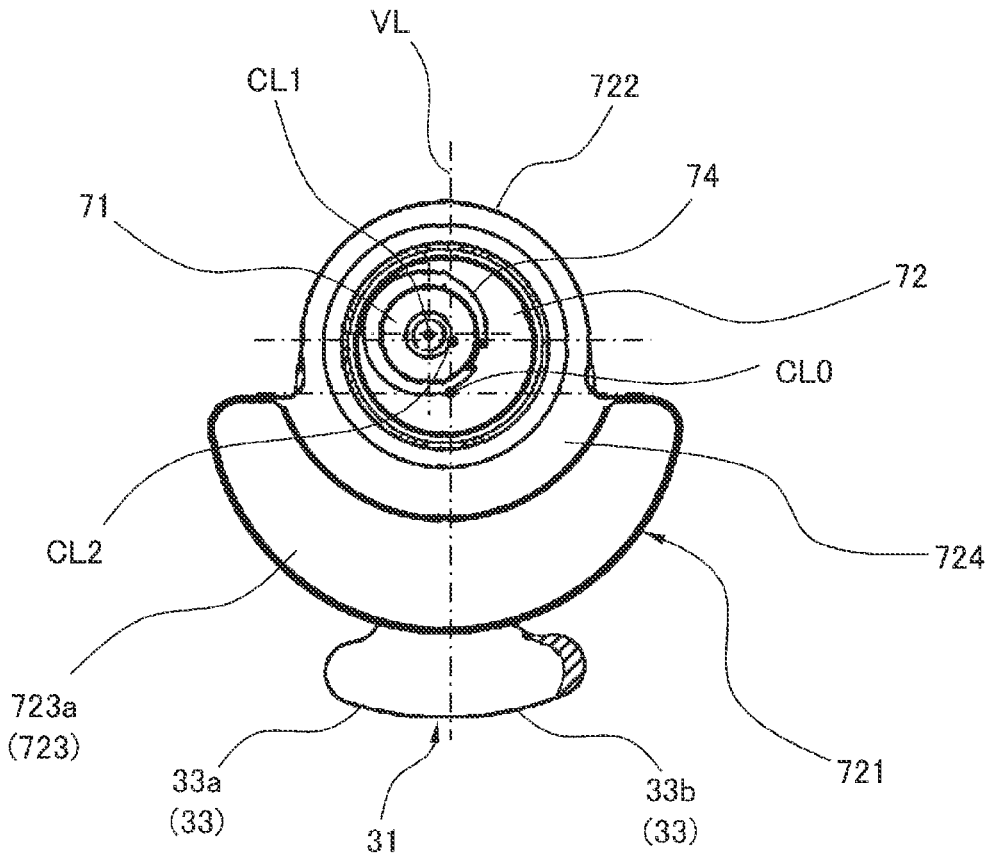
FIG. 6 is a drawing illustrating the shaft balancer and the bushing balancer seen from a direction opposite the direction in FIG. 5.

FIG. 3 is a perspective view illustrating an arrangement of the shaft balancer 31, the first rotor balancer 421, the second rotor balancer 422, and the bushing balancer 721; and FIG. 4 is an exploded perspective view illustrating mainly the shaft balancer 31 and the bushing balancer 721. Also, FIG. 5 is a drawing illustrating the shaft balancer 31 and the bushing balancer 721 seen from the axial direction of the drive shaft 30 (in this example, from the front side), FIG. 6 is a drawing illustrating the shaft balancer 31 and the bushing balancer 721 seen from a direction opposite the direction in FIG. 5 (in this example, from the rear side). In the descriptions below, a size in the longitudinal direction, i.e., a size along the axial direction of the drive shaft 30, is referred to as a "thickness", and a size in the lateral direction is referred to as a "width".

The shaft balancer 31 is fixed to the outer peripheral surface of the drive shaft 30 near the rear end of the drive shaft 30 (i.e., near the end closer to the eccentric pin 71) and rotates together with the drive shaft 30. In the present embodiment, the shaft balancer 31 is disposed in the back pressure chamber H5. The shaft balancer 31 includes an annular attaching part (hereafter referred to as "first attaching part") 32 to be fitted on and fixed to the outer peripheral surface of the drive shaft 30, a weight (hereafter referred to as "first weight") 33 disposed apart from the first attaching part 32 on the opposite side from the eccentric pin 71 with respect to the center line CL0 of the drive shaft 30, and a connecting part (hereafter referred to as "first connecting part") 34 that connects the first attaching part 32 to the first weight 33. Also, in the present embodiment, the shaft balancer 31 is formed with a constant thickness, and the first connecting part 34 is formed to be narrower than the first weight 33.

Referring to FIGS. 5 and 6, when the shaft balancer 31 is seen from the axial direction of the drive shaft 30, the shaft balancer 31 is asymmetric with respect to a virtual line VL passing through the center (center line CL0) of the drive shaft 30 and the center (center line CL2) of the eccentric bush 72. Specifically, the first weight 33 of the shaft balancer 31 is asymmetric with respect to the virtual line VL (each of the first attaching part 32 and the first connecting part 34 is symmetric with respect to the virtual line VL). More specifically, the first weight 33 is formed such that the mass (or weight) of a second portion 33*b* disposed on the opposite side from the center (center line CL1) of the eccentric pin 71 with respect to the virtual line VL is greater than the mass (or weight) of a first portion 33*a* disposed on the same side as the center (center line CL1) of the eccentric pin 71 with respect to the virtual line VL. In the present embodiment, because the shaft balancer 31 has a constant thickness as described above, the second portion 33*b* of the first weight 33 is larger than the first portion 33*a* of the first weight 33 in the width direction by an amount indicated by hatching in FIGS. 5 and 6.

The bushing balancer 721 is fixed to the outer peripheral surface of the eccentric bush 72 near the front end of the eccentric bush 72 (i.e., near an end closer to the drive shaft 30), and rotates or swings together with the eccentric bush 72. Reference number 74 in FIGS. 4 and 6 indicates a snap ring that fixes the eccentric bush 72 attached to the eccentric pin 71. Similarly to the shaft balancer 31, the bushing balancer 721 is disposed in the back pressure chamber H5. The bushing balancer 721 includes an annular attaching part (hereafter referred to as "second attaching part") 722 fitted onto and fixed to the outer peripheral surface 72*b* of the eccentric bush 72, a weight (hereafter referred to as "second weight") 723 disposed apart from the second attaching part 722 (in other words, eccentric bush 72) and on the radially outer side of the second attaching part 722 (eccentric bush 72), and a connecting part (hereafter referred to as "second connecting part") 724 that connects the second attaching part 722 to the second weight 723. In the present embodiment, the mass (or weight) of the bushing balancer 721 is greater than the mass (or weight) of the shaft balancer 31.

The second weight 723 is disposed on the opposite side from the center line CL1 of the eccentric pin 71 (=center line of the pin insertion hole 72*a*) with respect to the center line CL2 of the eccentric bush 72 and the center line CL0 of the drive shaft 30. The second weight 723 has a block shape, whereas the second connecting part 724 has a plate-like shape. In other words, the second weight 723 is thicker than the second connecting part 724.

Referring to FIGS. 5 and 6, when the bushing balancer 721 is seen from the axial direction of the drive shaft 30, the combination of the second weight 723 and the second connecting part 724 has a semicircular shape. However, the present invention is not limited to this example. When the bushing balancer 721 is seen from the axial direction of the drive shaft 30, the combination of the second weight 723 and the second connecting part 724 may have a substantially fan shape. The bushing balancer 721 is symmetric with respect to the virtual line VL.

The second weight 723 includes an arc-shaped rear protrusion 723*a* protruding backward (i.e., toward the orbiting scroll 52) with respect to the second connecting part 724, and a pair of arc-shaped front protrusions 723*b* protruding forward (i.e., toward the shaft balancer 31) with respect to the second connecting part 724. Each of the pair of front protrusions 723*b* is smaller than the rear protrusion 723*a*. The pair of front protrusions 723*b* are disposed apart from each other and are symmetric with respect to the virtual line VL. In the present embodiment, a part of the first attaching part 32 and the first connecting part 34 of the shaft balancer 31 are disposed between the pair of front protrusions 723*b* of the bushing balancer 721 (see FIG. 5). In other words, a distance D1 in the shaft balancer 31 from the center line CL0 of the drive shaft 30 to the tip of the first weight 33 is greater than a distance D2 in the bushing balancer 721 from the center line CL0 of the drive shaft 30 to the tip of the second weight 723.

The first rotor balancer 421 is fixed to the rear end face of the rotor 42, in other words, to the end face of the rotor 42 closer to the shaft balancer 31, and rotates together with the rotor 42 (i.e., the drive shaft 30). The first rotor balancer 421 has an arc shape and, similarly to the first weight 33 of the shaft balancer 31, is disposed on the opposite side from the eccentric pin 71 with respect to the center line CL0 of the drive shaft 30. That is, the first rotor balancer 421 is disposed to face the first weight 33 of the shaft balancer 31.

The second rotor balancer 422 is fixed to the front end face of the rotor 42, i.e., to a surface of the rotor 42 that is opposite the surface closer to the orbiting scroll 52, and rotates together with the rotor 42 (i.e., the drive shaft 30). The second rotor balancer 422 has an arc shape and is disposed on the same side as the eccentric pin 71 with respect to the center line CL0 of the drive shaft 30.

The scroll compressor 10 according to the embodiment provides effects as described below.

The scroll compressor 10 includes the bushing balancer 721 integrated with the eccentric bush 72. The bushing balancer 721 includes the second weight 723 that is disposed on the radially outer side of the eccentric bush 72 and on the opposite side from the center line CL1 of the eccentric pin 71 (pin insertion hole 72*a*) with respect to the center line CL2 of the eccentric bush 72.

Although a centrifugal force is generated in the orbiting scroll 52 when the orbiting scroll 52 orbits, this centrifugal force generated in the orbiting scroll 52 is offset by the centrifugal force of the bushing balancer 721. With this configuration, the pressing force of the orbiting spiral wall 522 against the fixed spiral wall 512 is maintained at a proper value. This in turn suppresses an increase in the wear of the fixed spiral wall 512 and/or the orbiting spiral wall 522 and a damage to the fixed spiral wall 512 and/or the orbiting spiral wall 522. Furthermore, the above configuration makes it possible to achieve a good sealing property (airtightness) of the compression chamber H2 formed between the fixed scroll 51 and the orbiting scroll 52.

The scroll compressor 10 includes, in addition to the bushing balancer 721, the shaft balancer 31 integrated with the drive shaft 30. The second weight 723 of the bushing balancer 721 is disposed on the opposite side from the center line CL1 of the eccentric pin 71 with respect to the center line CL2 of the eccentric bush 72 and is also disposed on the opposite side from the eccentric pin 71 with respect to the center line CL0 of the drive shaft 30. The shaft balancer 31 includes the first weight 33 disposed on the opposite side from the eccentric pin 71 with respect to the center line CL0 of the drive shaft 30. When the shaft balancer 31 and the bushing balancer 721 are seen from the axial direction of the drive shaft 30, the second weight 723 is symmetric with respect to the virtual line VL passing through the center line CL0 of the drive shaft 30 and the center line CL2 of the eccentric bush 72, and the first weight 33 is asymmetric with respect to the virtual line VL. Specifically, the first weight 33 of the shaft balancer 31 is formed such that the mass (or weight) of the second portion 33*b* disposed on the opposite side from the center (center line CL1) of the eccentric pin 71 with respect to the virtual line VL is greater than the mass (or weight) of the first portion 33*a* disposed on the same side as the center (center line CL1) of the eccentric pin 71 with respect to the virtual line VL.

With this configuration, for all movable components including the drive shaft 30 and components fixed or connected to the drive shaft 30, a balance in the vertical direction along the virtual line VL can be achieved by the shaft balancer 31 and the bushing balancer 721, and a balance in the lateral direction, which passes through the center of the drive shaft 30 and is orthogonal to the virtual line VL, can be achieved mainly by the shaft balancer 31. This in turn suppresses the vibration of the first bearing 214 and the second bearing 235 supporting the drive shaft 30 and improves the quietness and the low vibration characteristics particularly in the high rotation speed range.

When the shaft balancer 31 and the bushing balancer 721 are seen from the axial direction of the drive shaft 30, the second weight 723 of the bushing balancer 721 includes a pair of front protrusions 723*b* that protrude toward the shaft balancer 31 and are disposed apart from each other across the virtual line VL, and the first connecting part 34 of the shaft balancer 31 is disposed between the pair of front protrusions 723*b*. With this configuration, the first connecting part 34 of the shaft balancer 31 functions as a stopper for limiting the rotation range (or swing range) of the bushing balancer 721 (eccentric bush 72) and prevents the eccentric bush 72 and the bushing balancer 721 from rotating (swinging) more than necessary due to, for example, inertia. This configuration also makes it possible to reduce the space necessary to accommodate the shaft balancer 31 and the bushing balancer 721 in the axial direction of the drive shaft 30.

Furthermore, the scroll compressor 10 includes the first rotor balancer 421 that is fixed to the rear end face of the rotor 42 closer to the shaft balancer 31 and is disposed on the opposite side from the eccentric pin 71 with respect to the center line CL0 of the drive shaft and the second rotor balancer 422 that is fixed to the front end face of the rotor 42, which is opposite the end face closer to the shaft balancer 31, and is disposed on the same side as the eccentric pin 71 with respect to the center line CL0 of the drive shaft 30.

With this configuration, for all movable components including the drive shaft 30 and components fixed or connected to the drive shaft 30, it is possible to more accurately adjust the balance in a direction (vertical direction) along the virtual line VL while achieving the balance in the longitudinal direction corresponding to the axial direction of the drive shaft 30. This in turn makes it possible to more effectively suppress the vibration of the first bearing 214 and the second bearing 235 supporting the drive shaft 30 and to further improve the quietness and the low vibration characteristics of the scroll compressor 10.

In the above-described embodiment, the second portion 33*b* of the first weight 33 of the shaft balancer 31 is larger than the first portion 33*a* of the first weight 33 in the width direction. However, the present invention is not limited to this example. As another example, a part or the entirety of the second portion 33*b* may be thicker than the first portion 33*a*.

In the above-described embodiment, the bushing balancer 721 is formed separately from the eccentric bush 72 and is fixed to the outer peripheral surface of the eccentric bush 72. However, the present invention is not limited to this example. The eccentric bush 72 and the bushing balancer 721 may be molded into a unitary structure. That is, the eccentric bush 72 and the bushing balancer 721 may be formed as a single component (an eccentric bush with a balancer).

Furthermore, although the first weight 33 and the first connecting part 34 of the shaft balancer 31 are described as separate components in the above embodiment, the first weight 33 and the first connecting part 34 may be collectively referred to as a weight of the shaft balancer 31. Similarly, although the second weight 723 and the second connecting part 724 of the bushing balancer 721 are described as separate components in the above embodiment, the second weight 723 and the second connecting part 724 may be collectively referred to as a weight of the bushing balancer 721.

An embodiment and variations of the present invention are described above. However, the present invention is not limited to the above-described embodiment and variations and clearly, the embodiment and variations may be further modified based on the technical concept of the present invention.

REFERENCE SYMBOL LIST

10 . . . scroll compressor, 30 . . . drive shaft (driving force transmission mechanism), 31 . . . shaft balancer, 32 . . . first attaching part, 33 . . . first weight, 34 . . . first connecting part, 40 . . . electric motor, 41 . . . stator core unit, 42 . . . rotor, 51 . . . fixed scroll, 52 . . . orbiting scroll, 71 . . . eccentric pin (driving force transmission mechanism), 72 . . . eccentric bush (driving force transmission mechanism), 73 . . . bearing, 421 . . . first rotor balancer, 422 . . . second rotor balancer, 511 . . . fixed base plate, 512 . . . fixed spiral wall, 521 . . . orbiting base plate, 522 . . . orbiting spiral wall, 523 . . . cylindrical part, 721 . . . bushing balancer, 722 . . . second attaching part, 723 . . . second weight, 723*a* . . . rear protrusion, 723*b* . . . front protrusion (protrusion), CL0 . . . center line of drive shaft, CL1 . . . center line of eccentric pin, CL2 . . . center line of eccentric bush, H1 . . . intake chamber, H2 . . . compression chamber, H3 . . . discharge chamber, H4 . . . gas-liquid separation chamber, H5 . . . back pressure chamber, L2 . . . discharge hole, VL . . . virtual line

The invention claimed is:

1. A scroll compressor comprising:

a fixed scroll including a fixed base plate and a fixed spiral wall erected on the fixed base plate;

an orbiting scroll including an orbiting base plate, an orbiting spiral wall that is erected on one surface of the orbiting base plate and meshes with the fixed spiral wall, and a cylindrical part erected on another surface of the orbiting base plate;

a compression chamber formed between the fixed scroll and the orbiting scroll; and a driving force transmission mechanism that includes a drive shaft to be rotated, an eccentric pin provided at one end of the drive shaft, and an eccentric bush rotatably attached to the eccentric pin and rotatably inserted into the cylindrical part via a bearing, and transmits a driving force to the orbiting scroll, wherein the scroll compressor is configured such that a volume of the compression chamber changes and a fluid taken into the compression chamber is thereby compressed when the orbiting scroll orbits by the driving force relative to the fixed scroll;

the scroll compressor further comprises a shaft balancer that is integrated with the drive shaft and includes a first weight disposed on an opposite side from the eccentric pin with respect to a center line of the drive shaft, and a bushing balancer that is integrated with the eccentric bush and includes a second weight disposed on a radially outer side of the eccentric bush and on an opposite side from a center line of the eccentric pin with respect to a center line of the eccentric bush; and in a view from an axial direction of the drive shaft, the second weight is symmetric with respect to a virtual line passing through a center of the drive shaft and a center of the eccentric bush, and the first weight is asymmetric with respect to the virtual line.

2. The scroll compressor as claimed in claim 1, wherein in the view from the axial direction of the drive shaft, the first weight is formed such that a mass of a portion of the first weight located on an opposite side from the eccentric pin with respect to the virtual line is greater than a mass of a portion of the first weight located on a same side as the eccentric pin with respect to the virtual line.

3. The scroll compressor as claimed in claim 1, wherein in the view from the axial direction of the drive shaft, the second weight includes a pair of protrusions that protrude toward the shaft balancer and are disposed apart from each other across the virtual line, and a part of the shaft balancer is disposed between the pair of protrusions.

4. The scroll compressor as claimed in claim 3, wherein a mass of the bushing balancer is greater than a mass of the shaft balancer; and a distance from the center line of the drive shaft to a tip of the first weight is greater than a distance from the center line of the drive shaft to a tip of the second weight.

5. The scroll compressor as claimed in claim 1, further comprising:

an electric motor that includes a rotor fixed to the drive shaft and a stator core unit disposed on a radially outer side of the rotor and that rotates the drive shaft;

a first rotor balancer fixed to an end face of the rotor closer to the shaft balancer and disposed on an opposite side from the eccentric pin with respect to the center line of the drive shaft; and a second rotor balancer fixed to an end face of the rotor opposite the end face closer to the shaft balancer and disposed on a same side as the eccentric pin with respect to the center line of the drive shaft.

6. The scroll compressor as claimed in claim 2, wherein in the view from the axial direction of the drive shaft, the second weight includes a pair of protrusions that protrude toward the shaft balancer and are disposed apart from each other across the virtual line, and a part of the shaft balancer is disposed between the pair of protrusions.

7. The scroll compressor as claimed in claim 2, further comprising:

an electric motor that includes a rotor fixed to the drive shaft and a stator core unit disposed on a radially outer side of the rotor and that rotates the drive shaft;

a first rotor balancer fixed to an end face of the rotor closer to the shaft balancer and disposed on an opposite side from the eccentric pin with respect to the center line of the drive shaft; and a second rotor balancer fixed to an end face of the rotor opposite the end face closer to the shaft balancer and disposed on a same side as the eccentric pin with respect to the center line of the drive shaft.

8. The scroll compressor as claimed in claim 3, further comprising:

an electric motor that includes a rotor fixed to the drive shaft and a stator core unit disposed on a radially outer side of the rotor and that rotates the drive shaft;

a first rotor balancer fixed to an end face of the rotor closer to the shaft balancer and disposed on an opposite side from the eccentric pin with respect to the center line of the drive shaft; and a second rotor balancer fixed to an end face of the rotor opposite the end face closer to the shaft balancer and disposed on a same side as the eccentric pin with respect to the center line of the drive shaft.

9. The scroll compressor as claimed in claim 4, further comprising:

an electric motor that includes a rotor fixed to the drive shaft and a stator core unit disposed on a radially outer side of the rotor and that rotates the drive shaft;

a first rotor balancer fixed to an end face of the rotor closer to the shaft balancer and disposed on an opposite side from the eccentric pin with respect to the center line of the drive shaft; and a second rotor balancer fixed to an end face of the rotor opposite the end face closer to the shaft balancer and disposed on a same side as the eccentric pin with respect to the center line of the drive shaft.

* * * * *